United States Patent [19]

Falcetti

[11] 4,227,820

[45] Oct. 14, 1980

[54] ENDLESS INK-RIBBON CARTRIDGE

[75] Inventor: Carlo G. Falcetti, Milan, Italy

[73] Assignee: Honeywell Inc., Minneapolis, Minn.

[21] Appl. No.: 896,642

[22] Filed: Apr. 17, 1978

[30] Foreign Application Priority Data

Apr. 21, 1977 [IT] Italy ..... 22674 A/77

[51] Int. Cl.[3] ..... B41J 33/10

[52] U.S. Cl. ..... 400/195; 400/196.1

[58] Field of Search ..... 400/194, 195, 196, 196.1

[56] References Cited

U.S. PATENT DOCUMENTS

| | | | |
|---|---|---|---|
| 3,941,231 | 3/1976 | Matuck et al. | 400/196.1 |
| 3,974,906 | 8/1976 | Lee et al. | 400/196.1 |

FOREIGN PATENT DOCUMENTS

| | | | |
|---|---|---|---|
| 2551989 | 5/1976 | Fed. Rep. of Germany | 400/196.1 |

*Primary Examiner*—Ernest T. Wright, Jr.

*Attorney, Agent, or Firm*—Lewis P. Elbinger

[57] ABSTRACT

An endless ink-ribbon cartridge for printing, wherein the ribbon is formed into a Mobius loop, and wherein the ribbon is inverted in one arm of the cartridge by a pair of deflecting elements in the ribbon path.

6 Claims, 9 Drawing Figures

$\ell = h$
$\Delta = 0$ $\ell = 2h$
$\Delta = 3/8\,h$ $\ell < 2h$
$\Delta > 3/8\,h$

ENDLESS INK-RIBBON CARTRIDGE

BACKGROUND OF THE INVENTION

This invention relates to endless ink-ribbon cartridges which recently have found widespread use in typewriters and in high-speed printers utilized in information processing systems.

One cartridge of this type, for example, is described in the Italian patent application No. 24128A/76, filed June 10, 1976, and assigned to the assignee to the instant application, and subsequently filed in the United States on Dec. 13, 1976, as application Ser. No. 750,033 by F. Carlevaro and A. Gaboardi, as signed to the assignee of the instant application.

Such cartridges employ the principle of storing the ink-ribbon in random manner in an internal housing. Because of this fact, the quantity, or length, of ribbon which can be stored is less than the quantity which can be stored on a reel of equivalent dimensions on which, the ribbon is wound in a uniform manner.

A consequence of this random form of storage is a limited ribbon life, due to exhaustion of the ink with which the ribbon is impregnated or due to the actual wearing out of the ribbon. While the exhaustion of the ink can be obviated by disposing reinking devices in the cartridge, the problems of the wearing out of the ribbon have been found to be remedied only by using ribbons of greater length.

It is known that for ribbons formed into a closed loop, an equivalently greater length of ribbon can be obtained by utilizing a ribbon of greater width connected to provide in the ribbon an inversion or twist of 180°, in a manner to form a Mobius loop. Such a technique enables the use of two parallel bands of the ribbon for the printing, and the passage from one of the bands to the other occurs without discontinuity by taking advantage of the properties of the Mobius loop.

In order to exploit such an expedient, it is necessary that the ribbon inversion be confined to a well-defined position in the path of the ribbon, and that the inversion move along the ribbon as the ribbon moves along such path, even as the ribbon exits from and reenters into the cartridge.

In the French Pat. No. 2,165,444, published Aug. 3, 1973, for example, there is described an endless ink-ribbon cartridge wherein the ribbon is connected in the form of a Mobius loop; For such cartridge the inversion of the ribbon is effected externally to the containing cartridge in a zone of the printer provided with guide elements disposed downstream and upstream of the inversion zone. The inversion is readily effected between such guide elements by virtue of the relative pliability of the ribbon. However, this approach has the disadvantage of requiring a manipulation of the ribbon that is preferably avoided and of requiring, in addition, a free zone for the inversion of length at least five times the width of the ribbon to assure appropriate inversion of the ribbon.

The French Pat. Nos. 2,276,939 and 2,291,037, published respectively Mar. 5, 1976, and July 16, 1976, describe other cartridges in which such disadvantages of manipulation of the ribbon is avoided. In one of such patents use is made of an appropriate guide which is an integral part of the cartridge, and in the other of these patents the inversion is effected in an appropriate compartment provided in the cartridge.

In order to assure that the inversion occurs properly and does not migrate out of the zone, or compartment, in which it is intended that the inversion should occur, transverse guides are disposed in a median position of the inversion zone. These guides form a slot or a kind of drawplate oriented perpendicularly to the direction of movement of the ribbon and to the plane along which the ribbon would continue to move, absent the inversion.

However, even such expedients are not entirely satisfactory because such an arrangement requires that the edges of the ribbon be stretched relative to the central portion thereof in order to follow a path of greater length. Such stretching tends to cause a folding of the ribbon on itself, particularly if the ribbon is partially worn from use, with the consequent migration of the inversion outside of the zone provided or with the more serious consequence of the jamming of the cartridge.

These disadvantages are minimized only partially by providing an inversion zone sufficiently long to require only a minimum of stretching of the edges relative to the central portion of the ribbon.

Accordingly, it is the object of the present invention to provide an ink-ribbon cartridge which obviates the above-mentioned disadvantages of prior art ink-ribbon cartridges.

Another object of the present invention is to provide an ink-ribbon cartridge wherein unequal stretching of the ink-ribbon elements is avoided.

Another object of the present invention is to provide an ink-ribbon cartridge of the type in which the ink-ribbon is connected in the form of a Mobius loop wherein the inversion is effected in a manner to reduce the frictional drag on the ink-ribbon.

Another object of the present invention is to provide an ink-ribbon cartridge of the type in which the ink-ribbon is connected in the form of a Mobius loop wherein the central portion of the ink-ribbon is stretched slightly more than the edges thereof in effecting the required inversion.

SUMMARY OF THE INVENTION

The above-mentioned disadvantages of prior art ink-ribbon cartridges are eliminated by the cartridge of the present invention, wherein the inversion is guided by means of deflecting elements which appropriately bend the ink-ribbon in a manner such that each elemental fiber of the ink-ribbon oriented along the length of the ribbon follows a path of equal length.

According to another aspect of the present invention, the bending of the ink-ribbon by such deflecting elements is reduced to the minimum, so that the resulting angle of twist of the ink-ribbon is roughly between 90° and 180°, thereby reducing the frictional drag which opposes the driving of the ribbon.

According to yet another aspect of the present invention, these deflecting elements exhibit a slightly convex bending profile, whereby the central fibers of the ink-ribbon, considered in the direction of the ribbon length, are slightly stretched relative to the edges of the ink-ribbon. In this manner, an action is exerted on the ribbon which tends to maintain it stretched on the deflecting elements along the direction of its width, avoiding the danger of the ribbon folding on itself with the above-mentioned consequent disadvantages.

BRIEF DESCRIPTION OF THE DRAWING

The invention will be described with reference to the accompanying drawing, wherein.

DESCRIPTION OF THE PREFERRED EMBODIMENT

Figure 1:
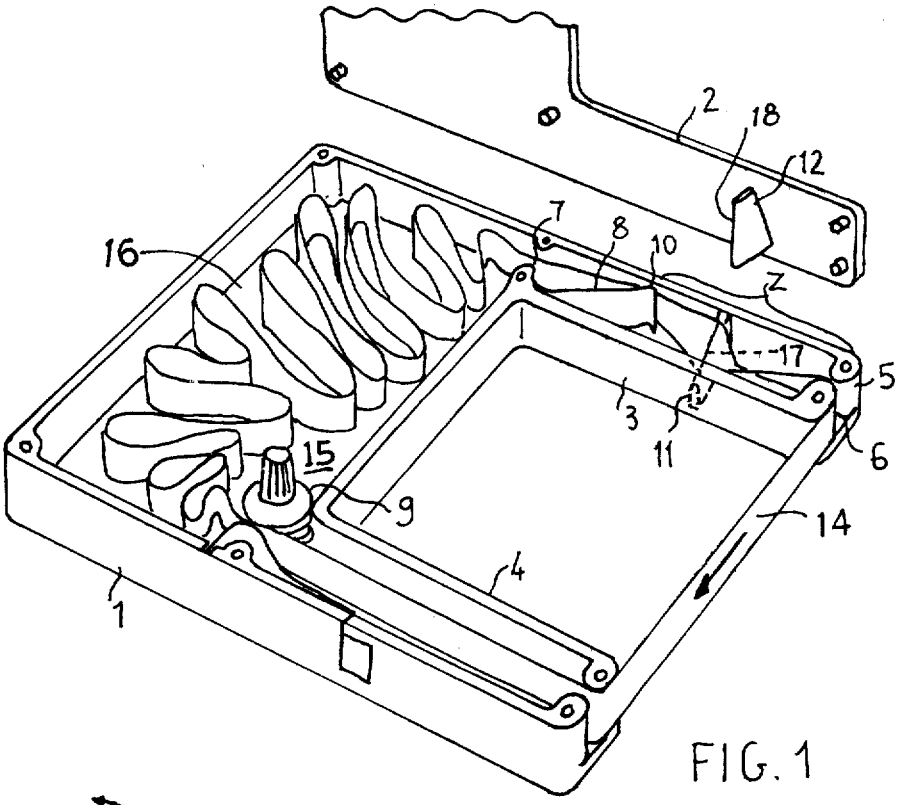
FIG. 1 is a perspective view of the endless ink-ribbon cartridge of the invention, illustrated with the top cover in an open position.

The ink-ribbon cartridge 1 of FIG. 1 is illustrated as being opened, with its top cover 2 rotated through 90° and only partially visible above the cartridge 1, in order to better illustrate the features of the invention. Only those details of the construction of the cartridge 1 necessary to an understanding of the present invention will be provided herein; for additional details reference is made to the aforementioned patent application Ser. No. 750,033 and to the above-mentioned prior art.

The ink-ribbon 14 emerges from an arm 3 through a vertical aperture in the end thereof, defined by the tips of two parallel guides 5 and 6, and reenters into cartridge 1 through a similar vertical aperture at the end of an arm 4. The movement of the ink-ribbon 14 in the direction of the arrow is performed by a driving mechanism 9 disposed inside cartridge 1 and described in one form in said patent application Ser. No. 750,033, and in other forms in the above-mentioned prior art.

The ink-ribbon 14 is closed on itself to form a loop, with an inversion of 180° to provide a Mobius loop, and is stored in random manner in a magazine 15 of cartridge 1. The inversion of the ribbon 14 is suitably confined to the inside of arm 3.

The ink-ribbon 14 passes from magazine 15 into arm 3 through a narrow vertical slot 7, which prevents packets of ribbon folds from entering into arm 3. A leaf spring 8 presses the ribbon 14 against an internal wall of arm 3 to exert a certain resisting friction on the ribbon 14 that assures an appropriate tension on the portion of the ribbon 14 lying between such spring 8 and driving mechanism 9.

The inversion of the ribbon 14 is confined to a zone, identified as zone Z, disposed between the tip 10 of spring 8 and guides 5 and 6.

According to the invention, this inversion is precisely controlled in a manner such that each fiber of the ink-ribbon 14, oriented along the length of the ribbon 14, follows a path of the same length in the inversion zone Z. Such control is obtained through the use of two deflecting elements 11 and 12.

Deflecting element 11, shown partially by dashed lines in FIG. 1, is disposed inside arm 3 perpendicularly to the bottom wall 16 of cartridge 1. Deflecting element 11 has a rounded guiding edge 17 that extends from one side to the other of arm 3 and is provided with an appropriate slope and with a certain obliquity with respect to the path of the ribbon 14, i.e., with respect to the vertical plane defined by tip 10 of spring 8 and the slot defined between guides 5 and 6. Although not essential, deflecting element 11 may be formed as a part of arm 3 of cartridge 1, being formed with the molding, or other forming, of arm 3, without causing the problem of undercut or any other problems. In fact, for economy, these kinds of cartridges are usually fabricated by molding plastic material.

Deflecting element 12 is also disposed inside arm 3 and is preferably part of top cover 2 of cartridge 1, as shown in FIG. 1. Element 12 may be fabricated during the molding of top cover 2 without creating problems of any sort. When top cover 2 is closed on the body of cartridge 1, deflecting element 12 assumes a position adjacent to that of element 11, with a guiding edge 18 that extends from one side to the other of arm 3. The guiding edge 18 of element 12 is provided with an appropriate slope and with a certain obliquity, which slope and obliquity are opposite to that provided for the guiding edge 17 of deflecting element 11.

The arrangement of deflecting elements 11 and 12 and their guiding and inverting effect on the ink-ribbon 14 is better described by reference to FIG. 2 and the following figures.

For clarity of description and illustration, the positions of deflecting elements 11 and 12 are defined by reference to a system of orthogonal cartesian coordinates x, y, w. The vertical guides 5 and 6 (shown schematically for simplicity as two cylinders) and the tip 10 of spring 8 as opposed by a section of the wall of arm 3 (such section being shown schematically for simplicity as a cylinder 13) define two vertical ribbon guide slots C and D and delimit ribbon inversion zone Z. These two guide slots C and D lie in the x-w plane and are parallel to and equidistant from the w axis.

If not acted upon by deflecting elements 11 and 12 to provide an inversion, the ribbon 14 would pass through zone Z along the x-w plane, with the lower edge of the ribbon 14 in registration with the x axis. The x-y plane represents the plane of the bottom wall 16 of cartridge 1 and of arm 3. The ribbon 14, if undeflected, would extend above the x-y plane to a height h equal to the width of the ribbon 14.

Figure 2:
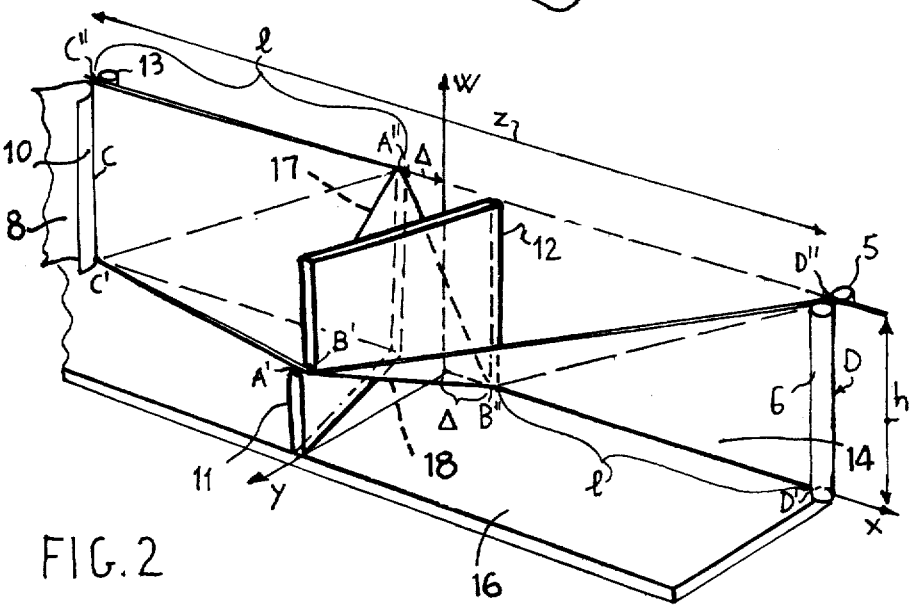
FIG. 2 is a perspective view of a detail of the present invention.

Parallel to the x-y plane, above it and at a distance equal to or slightly greater than height h, is placed top cover 2 of the cartridge 1, not shown in FIG. 2.

The y-w plane is located in the middle of inversion zone Z.

Deflecting element 11 comprises a plate disposed on one side of the x-w plane and oriented vertically; i.e., in a plane parallel to the w axis. Such plate has a rectilinear rounded guiding edge 17, which edge 17 is defined in FIG. 2 by its extremities, or end points, A', A''. Point A' is located at a distance from the x-w plane equal to the width h of the ribbon 14, at a height above the x-y plane equal to h/2, and substantially in the middle of the inversion zone Z; i.e., in the y-w plane. Point A'' is located in the x-w plane, at a distance h above the x axis, and at a distance $\Delta$ from the w axis in the direction of the negative x coordinate of the reference system. The distance $\Delta$ is chosen according to geometric criteria which will be described hereinafter.

Deflecting element 12 comprises a plate disposed on the same side of the x-w plane as is element 11 and oriented vertically, i.e., in a plane parallel to the w axis. This plate also has a rectilinear rounded guiding edge 18, which edge 18 is defined in FIG. 2 by its extremities, or end points, B', B''. Point B' is located very close to point A' and, therefore, has substantially the same coordinates as point A'. Point B'' is located on the x axis at a distance Δ from the w axis, in the direction of the positive x coordinate; i.e., on the opposite side of the y-w plane from point A''.

The purpose of the guiding edges 17 and 18, defined by end points A', A'' and B', B'' is to appropriately deflect, or bend, the ink-ribbon 14 to provide an inversion, or 180° twist, in the ribbon 14 without introducing localized, or non-uniform, stresses in the ribbon 14. To this end, the lower edge of the ink-ribbon 14, upon emerging from lower point C' of guide slot C, instead of continuing along the x axis, is deflected upwardly and laterally to point A', B', and from the latter point deflected to the upper point D'' of guide slot D. It is evident that the total length C'A'+B+D'' of the two segments C'A' and B'D'' is greater than the distance C'D', the length of the inversion zone Z.

The upper edge of the ribbon 14, upon emerging from upper point C'' of guide slot C, continues to move in the x-w plane, parallel to the x axis, to point A'', from such point A'' is deflected downwardly to point B'', and from the latter point B'' is deflected along the x axis to point D'.

By an appropriate choice of the distance Δ of each of the points A'' and B'' from the w axis, it is possible to make the segment sum C''A''+A''B''+B''D' equal to the segment sum C'A'+B'D''. From simple geometrical considerations, based on the assumption that the length 1 of segment C''A'' is equal to segment B''D', it can be determined that the conditions for equal length between the paths of the two edges of the ribbon 14 are met when:

$$\Delta=(l^2-h^2)/4l \qquad (1)$$

Consider now the internal fibers of the ribbon 14, oriented along the length of the ribbon 14. Assuming that the bending of the ribbon 14 is concentrated along the dashed lines C'A'' and B''D'', the paths of such internal fibers imposed by deflecting elements 11 and 12, between the slots C and D, are equal to the length of the paths of the edges of the ribbon 14. This is readily proven by considering the similarity of the triangles involved.

Figure 3:
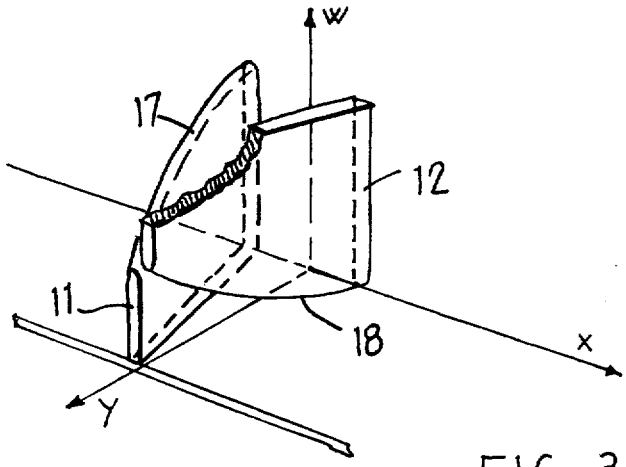
FIG. 3 is a perspective view of a detail of another embodiment of the present invention.

If it is assumed, instead, and as actually occurs, that the ribbon 14 is bent in a more distributed and uniform manner in the vicinity of such lines, the paths of the internal fibers become slightly shorter and cause a non-uniform distribution of stresses in the crosssection of the ribbon 14. The resulting disadvantage, although relatively slight, can be overcome by shaping the guiding edges 17 and 18 of respective deflecting elements 11 and 12 so that they will be slightly convex. Such convex guiding edges 17 and 18 increase the distance of points of the guiding edge 17 of element 11 between its extremities A', A'' from corresponding points of the guiding edge 18 of element 12 between its extremities B'B'' relative to what such distances are between corresponding points of two rectilinear guiding edges. Such an arrangement as shown in FIG. 3 where, for clarity, the ink-ribbon 14 is not shown.

By further increasing the convexity of the guiding edges 17 and 18, it is possible to make the paths of the central fibers of the ribbon 14 slightly longer than the paths of the edges, thereby inducing a greater stress in the center of the ribbon 14 than along the edges. Such an arrangement prevents the edges of the ribbon 14 from tending to fold back on themselves such as at slots C and D or at the guiding edges 17 and 18.

Figure 4A:
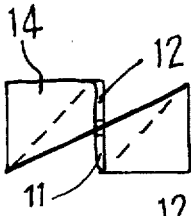
FIGS. 4*a* and 4*b* are respective front and top views of the inversion of the ink-ribbon effected by one form of the invention.
Figure 4B:
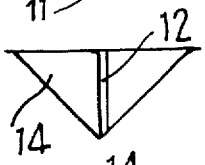
Figure 5A:
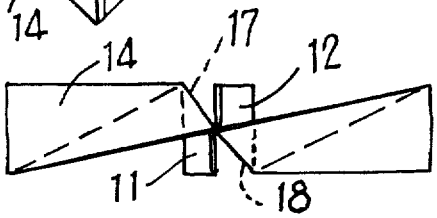
FIGS. 5*a* and 5*b* are respective front and top views of the inversion of the ink-ribbon effected by the invention for a different ratio of ribbon width to length of inversion zone than that illustrated in FIGS. 4*a* and 4*b*.
Figure 5B:
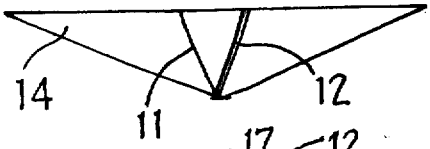

The above formula (1) demonstrates that if $l=h$, to have equality of the paths of the two edges the distance Δ must be 0. In this case, the deflecting elements 11 and 12 must be disposed substantially in the y-w plane. The embodiment of this arrangement is illustrated in FIGS. 4*a* and 4*b*, which show how the invention can be implemented in a zone Z of very short length, equal to 2h, although such embodiment has the disadvantage of being accompanied by a total angle of twist of the ribbon 14 over the deflecting elements 11 and 12 of approximately between 230° and 270°. On the other hand, for $l=2h$, the value of $\Delta=\frac{3}{8}h$, so that the total length of the inversion zone z is approximately equal to 5*h*. In this case, shown in FIGS. 5*a* and 5*b*, the total angle of twist of the ribbon 14 over the deflecting elements 11 and 12 is decidely less than 180°.

In practice, a length of inversion zone z between 3h and 4h is the best compromise to satisfy the requirements of minimum size for the inversion zone z and of minimum friction.

Figure 6A:
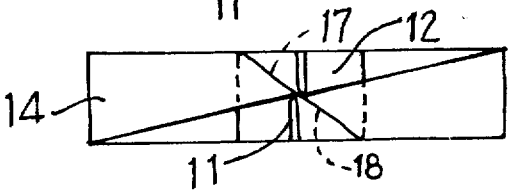
FIGS. 6*a* and 6*b* are respective front and top views of the inversion of the ink-ribbon effected by the invention for a different geometry of the invention than that illustrated in FIGS. 4*a* and 4*b* on the one hand and FIGS. 5*a* and 5*b* on the other hand.
Figure 6B:
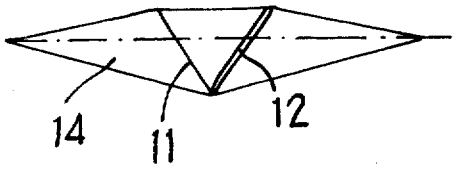

In the embodiments illustrated in FIGS. 2, 3, 4*a* and 4*b*, and 5*a* and 5*b* the inversion is effected by deflecting the ribbon 14 to only one side of the x-w plane. However, by adopting a distance Δ greater than the value determinable from formula (1) above, it is possible to provide an inversion which, while not disposed perfectly symetrically on both sides of the x-w plane, can, however, be disposed partially on one side of the x-w plane and partially on the other, as illustrated in FIGS. 6*a* and 6*b*.

In the different versions of the invention described above the guiding edges 17 and 18, defined by end points A' A'' and B' B'' (where they are rectilinear) define a plane perpendicular to the x-w plane that has a certain slope relative to the x-y plane. Such defined plane can be termed the "plane of inversion" because it is in conformity with such plane that the ribbon 14 is bent to obtain the inversion. The length of the inversion zone z relative to the width of the ribbon 14 enables defining the slope of the inversion plane to assure that the paths of the edges of the ribbon 14 in the inversion zone Z are of equal length. Equation (1) above defines a slope that provides an inversion performed on only one side of the x-w plane. By adopting a greater slope, which can be defined by geometrical and analytical criteria, with equal relationship between the length of the inversion zone z and the width of the ribbon 14, a controlled inversion can be obtained which is performed in both half spaces defined by the x-w plane and, therefore, roughly in a symmetrical manner. The same result can be obtained, without adopting a slope of the inversion zone z greater than that defined by equation (1), by utilizing guiding edges 17 and 18 having a lesser slope; i.e., having end points A'' and B'' disposed, instead of in correspondence the edges of the ribbon 14, between the edges and the middle of the ribbon 14. This is permitted within the limits of the pliability of the ribbon 14.

Similarly, the effect of a lesser slope of the inversion plane and a lesser slope of the guiding edges 17 and 18 can be combined to obtain a cumulative effect.

From what has been described above it is apparent that reasonable and practical modifications of the geometrical characteristics of the inversion device, as permitted by the pliability of the ribbon, are within the spirit of the invention and within the scope of the following claims.

I claim:

1. In an endless ink-ribbon cartridge, wherein the structure of a portion of said cartridge is oriented relative to a cartesian system of orthogonal reference axes x, y, w and related reference planes, apparatus for imparting to a ribbon an angular rotation of 180° around the longitudinal axis of said ribbon with minimum friction when said ribbon is in motion, said ribbon having first and second edges and a width h, said rotation being imparted to said ribbon in an inversion zone delimited by a pair of end guide slots within which said ribbon passes; said slots being located in the x-w plane substantially equidistant from the w axis and on the same side of the x axis such that one edge of said ribbon coincides with said x axis in at least said slots, comprising:

a pair of deflecting elements, each of said elements having a substantially rectilinear guiding edge, said elements being disposed in the path of said ribbon, each of said guiding edges acting on a different face of said ribbon for imparting a bending to said ribbon, said guiding edges intersecting substantially in the y-w plane at a distance from the x-y plane substantially equal to h/2 and defining a plane of inversion in conformity with which said ribbon is bent between said guiding edges, said plane of inversion being perpendicular to the x-w plane and having a slope with respect to the x-y plane such that the paths of said ribbon edges in the inversion zone are of equal length.

2. The apparatus of claim 1, wherein said guiding edges are convex.

3. In a cartridge for a printer wherein an endless ink-ribbon is disposed, wherein the majority portion of said ink-ribbon is stored randomly in a housing of said cartridge, and wherein said ink-ribbon has a width h and is connected on itself to form a Mobius loop, apparatus disposed in said cartridge for inverting said ribbon comprising:

first and second rectilinear slots, said slots being oriented parallel to and spaced apart from each other, whereby said slots define a first geometric plane, said slots being further oriented such that the bottom of each of said slots lies in a second geometric plane perpendicular to said first plane and perpendicular to said slots;

first and second elongated deflecting members disposed in the path of said ink-ribbon between said slots, one end of each of said members being disposed substantially in a third geometric plane, said third geometric plane being oriented perpendicular to said first plane and parallel to and midway between said slots, said one end of said members being further disposed at a distance h/2 above said second plane;

the other end of said first member being disposed to lie in said first plane, at a distance h above said second plane, and at a predetermined distance from said third plane toward said first slot; and the other end of said second member being disposed to lie in the line defining the intersection of said first and second planes and at said predetermined distance from said third plane toward said second slot;

wherein said ink-ribbon, upon being driven, passes through said first slot, is twisted to pass over said first member, is bent around said first member, is passed under said second member, is bent around said second member, and is twisted to pass through said second slot.

4. The apparatus of claim 3, wherein said deflecting members are rectilinear.

5. The apparatus of claim 3, wherein said deflecting members are convex.

6. The apparatus of claim 3, wherein said first slot comprises a spring member urged against a resisting surface.

* * * * *